United States Patent [19]

Gebauer

[11] 3,955,679

[45] May 11, 1976

[54] APPARATUS FOR SEPARATING REMANENT REEDBLADES FROM TUMBLING MEDIA

[75] Inventor: Bodo Gustav Gebauer, Algonquin, Ill.

[73] Assignee: GTE Automatic Electric Laboratories Incorporated, Northlake, Ill.

[22] Filed: Jan. 6, 1975

[21] Appl. No.: 538,654

[52] U.S. Cl. ..... 209/115; 209/29; 209/141

[51] Int. Cl.[2] ..... B07B 9/00

[58] Field of Search ..... 222/193, 461, 462; 209/115, 13, 17, 22, 23, 28, 29, 138, 139 R, 140, 141, 37

[56] References Cited

UNITED STATES PATENTS

| | | | |
|---|---|---|---|
| 1,073,451 | 9/1913 | Weaver | 209/139 R |
| 2,311,954 | 2/1943 | McLean | 209/139 R X |

FOREIGN PATENTS OR APPLICATIONS

| | | | |
|---|---|---|---|
| 2,444 | 6/1881 | United Kingdom | 209/29 |

*Primary Examiner*—Robert B. Reeves
*Assistant Examiner*—Joseph J. Rolla

[57] ABSTRACT

Apparatus for and method of separating elongated articles having certain aerodynamic properties from a mixture containing contaminating particles of random shape is disclosed wherein a housing is diagonally divided into upper and lower chambers with a separation apparatus communicating between the chambers. The separation apparatus includes a funnel disposed within the upper chamber, a diffuser tube disposed within the lower chamber and a tubular neck connecting the funnel to the diffuser tube. A hopper is disposed above the funnel for dispensing the mixture to the funnel. A fluid, such as air, is forced into the lower chamber at a sufficient pressure to establish a predetermined flow rate through the diffuser tube and tubular neck to the base of the funnel. This flow rate is adequate to create a "fluidized bed" in the mixture, at the base of the funnel, permitting the articles and contaminating particles to move relative to each other. As a result, the elongated articles align themselves with the flow and, ultimately, present a sufficiently reduced cross section to the flow that they are no longer supported by the flow. Consequently, they fall through the diffuser tube to the lower chamber; whereas the randomly shaped contaminating particles are supported by the flow and are carried into the upper chamber by the flowing fluid.

4 Claims, 5 Drawing Figures

APPARATUS FOR SEPARATING REMANENT REEDBLADES FROM TUMBLING MEDIA

This invention relates to the field of separation apparatus and more specifically to nonmagnetic separation apparatus.

Various types of nonmagnetic separation apparatus have been developed for separating selected, desired articles or materials, such as grain, from a mixture including contaminants, such as chaff. Such apparatus often employ flow channels which are complex, having numerous baffles and flow changing vanes. Those of the apparatus which are somewhat simple nevertheless employ the same basic principles employed by the more complex devices to effect separation; specifically, they rely for separation upon differences in the interactions of a flowing fluid with the desired articles and the contaminant. Such differences in interactions generally result from differences in the density and/or surface area of the contaminating particles with respect to the desired articles. By way of example, prior art separation apparatus of this type are disclosed in E. Condolious, U.S. Pat. No. 3,295,677, issued Jan. 3, 1967; H. Hardinge, U.S. Pat. No. 2,899,139, issued Aug. 11, 1950; G. C. Herz, U.S. Pat. No. 1,850,719, issued Mar. 22, 1932; I. K. L. Andren et al., U.S. Pat. No. 2,931,500, issued Apr. 5, 1960; F. Schaub et al., U.S. Pat. No. 2,766,880, issued Oct. 16, 1956.

While these separation apparatus are advantageous for separating "fine" articles from "course" particles, or vice versa, their efficacy diminishes as the differential between the respective densities and/or surface areas of the desired articles and contaminant particles decreases.

It is therefore an object of this invention to provide an improved separation apparatus and method for separating desired articles from contaminant particles of similar densities and/or total surface areas.

It is a more specific object of this invention to provide an improved separation apparatus and method for separating articles having predetermined aerodynamic characteristics from particles of random shape by means of controlled fluid flow.

It is a still more specific object of this invention to provide an improved separation apparatus and method wherein elongated articles having a preferred aerodynamic alignment axis are separated from randomly shaped particles by selectively subjecting the mixture to a fluid flow appropriate to create a "fluidized bed" in the mixture; whereby the preferred axis of the desired articles is aligned with the fluid flow and the area presented by such aligned articles to the fluid flow is substantially reduced.

Further and additional objects and advantages will appear from the description, accompanying drawings and appended claims.

In one specific embodiment of the invention, apparatus for separating articles having certain aerodynamic properties from a mixture including randomly shaped contaminant particles includes a housing divided into upper and lower chambers with an air exhaust port of a predetermined size in the upper chamber and an air inlet port of a predetermined size in the lower chamber. A separator assembly is mounted between the two chambers. The separator assembly includes a funnel connected to a tubular neck which, in turn, is connected to a diffuser tube including a plurality of holes around its perimeter. The funnel is connected at its top to a separator cage also including a plurality of holes around its cylindrical perimeter. A hopper is mounted above the apparatus and extends through the top surface of the separator cage to the top of the funnel. The hopper supplies the mixture including the desired articles to the separator assembly. A fluid, such as air, is forced through the inlet port from a source of pressure sufficient to achieve a flow rate which creates a "fluidized bed" in the mixture at the base of the funnel. More specifically, the contaminant particles and the desired articles are sufficiently lubricated by the fluid flow that they move relative to each other, bringing a preferred aerodynamic axis of the articles into alignment with the flow at the base of the funnel. As a result, the articles present a sharply reduced area to the fluid flow and they fall through the fluid flow into the lower chamber. The randomly shaped contaminant particles, however, are supported by the flow. Escaping fluid at the top of the funnel carries contaminant particles with it through the holes in the separator cage and the particles are collected in the upper chamber.

For a more complete understanding of this invention, reference should now be had to the embodiment illustrated to greater detail in the accompanying drawings and described below by way of an example of the invention.

Figure 1:
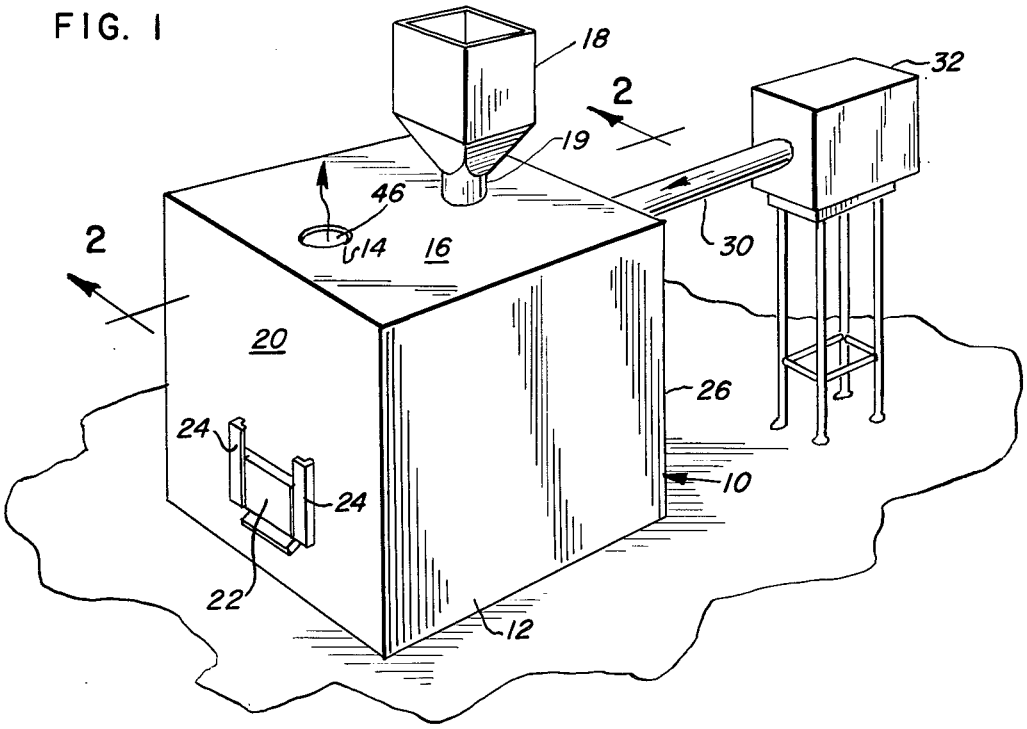
FIG. 1 is an oblique view of apparatus employing applicant's invention.

Referring to FIG. 1, an illustrative apparatus employing applicant's invention is shown generally at 10. The apparatus includes a housing 12 generally in the form of a cube, having an exhaust port 14 of a predetermined size in a top surface 16 of the housing. A hopper 18 is mounted above the top surface 16 with a transport tube 19 connected through the surface 16 to the interior of the housing. A front wall 20 of the housing includes a door 22, slidably mounted between side rails 24. A rear wall 26 includes an inlet port 28 (FIG. 2) which is connected by means of a tube 30 to a source of positive fluid (e.g., air) pressure 32.

Figure 2:
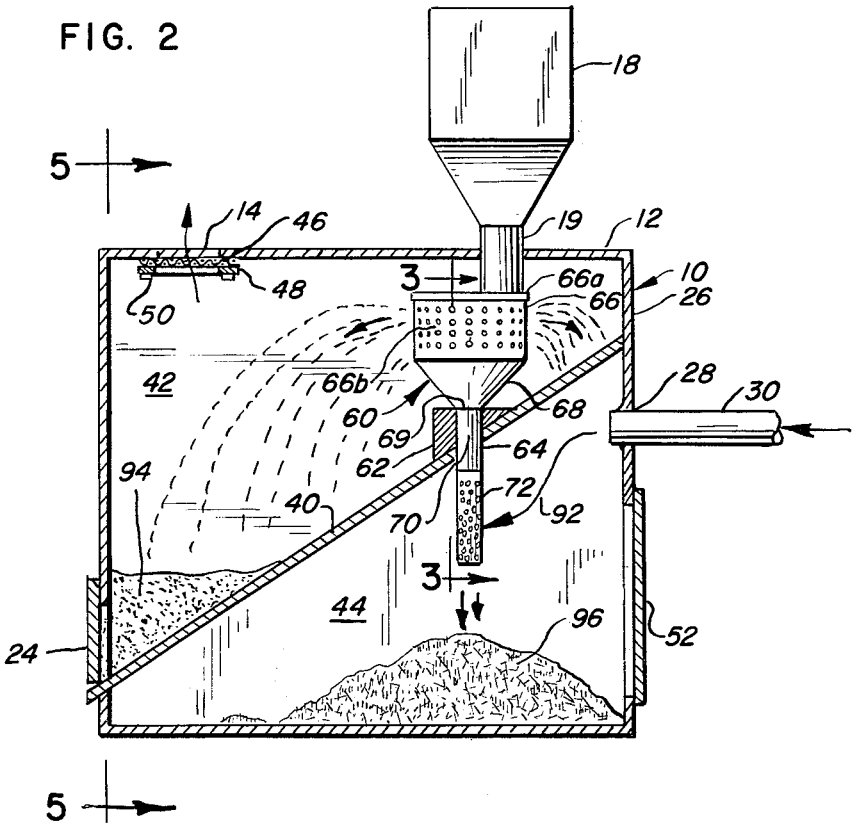
FIG. 2 is a sectional view taken along the line 2—2 shown in FIG. 1 looking in the direction of the arrows.
Figure 5:
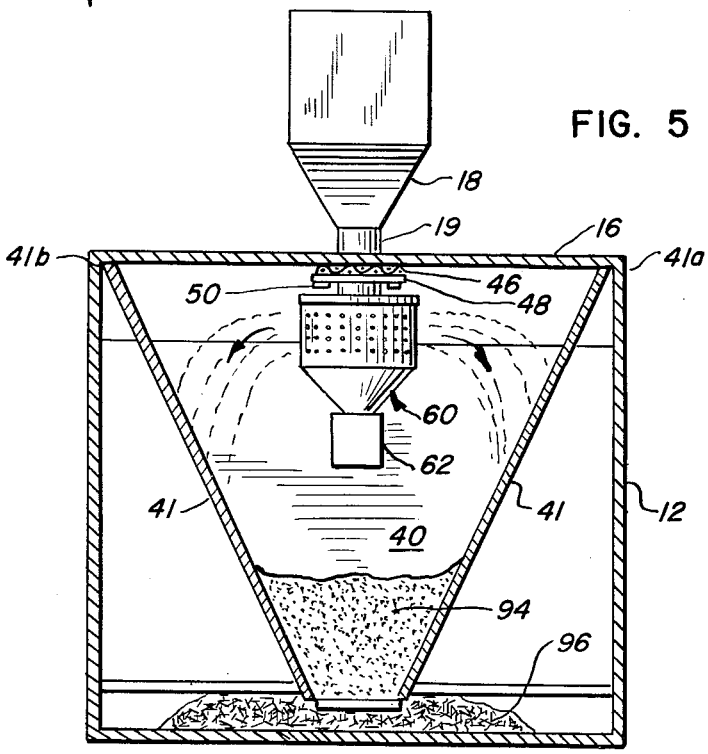
FIG. 5 is a sectional view of the separator apparatus along the line 5—5 shown in FIG. 2 looking in the direction of the arrows.

Referring to FIGS. 2 and 5, the housing 12 is diagonally bisected by a plate 40 which slopes upward from the base of the door 22. A pair of plates 41 adjoin the plate 40 and extend from upper corners **41*a* and 41*b* of the housing 12, respectively, to the lower extremes of the door 22. The plates 40 and 41 divide the interior of the housing 12 into an upper chamber 42 and a lower chamber 44. The aforementioned exhaust port 14 connects the chamber 42 to outside ambient pressure. The port 14 is covered internally of the housing by a screen 46 and a retaining plate 48 which is held in place by screws 50. The aforementioned inlet port 28 has access to the lower chamber 44. In addition, access may also be gained to the chamber 44 through a door 52 which is rotatably mounted to rear wall 26; the door 52 is sealed, when closed as shown, to prevent the venting of positive pressure from the chamber 44.**

A separator assembly shown generally at 60 is vertically mounted by a mounting block 62 through a passage 64 in the plate 40 between the chambers 42 and 44. The separator assembly 60 includes a cylindrical separator cage 66 connected to a funnel 68. The top surface 66*a* of the separator cage 66 includes a hole for receiving the transport tube 19 from the hopper 18; the cylindrical perimeter 66*b* of the cage includes a plurality of randomly spaced holes which, in the preferred embodiment, are approximately 0.125 inch in diameter. The funnel 68 is an inverted, truncated cone connected at its base or lower port 69, the point of truncation, to a tubular neck 70 which is connected to a diffuser 72 of cylindrical form. The diffuser 72 includes, in the preferred embodiment, a plurality of randomly spaced holes of approximately 0.015 inch diameter.

Figure 4:
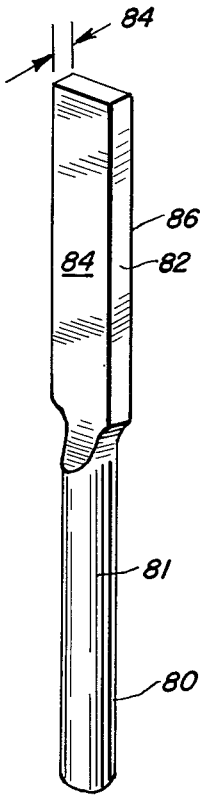
FIG. 4 is an enlarged, oblique view of a reed blade shown in FIG. 3.

As indicated above, this invention may be employed to separate desired articles, having certain aerodynamic properties, from randomly shaped contaminant particles. Illustrative of such articles is the reed blade 80 shown in FIG. 4 which is typically employed in reed switches or relays. It includes a cylindrical shank 81 which is connected approximately midway of the length of the reed blade to a paddle 82. The paddle 82 is of rectangular parallelepiped form, having opposing sides 84 and 86 of width approximately twice the diameter of the cylindrical shank 81. The depth 84 of the paddle 82 is approximately one-third of the diameter of the cylindrical shank 81. With these approximate dimensions, the elongated reed blade 80 characteristically rotates about its center of gravity in the presence of a fluid flow to present the least possible projected area normal to the flow; it is somewhat stable in such position due to the substantial weather-vaning effect produced by the large surface area of the paddle 82.

Figure 3:
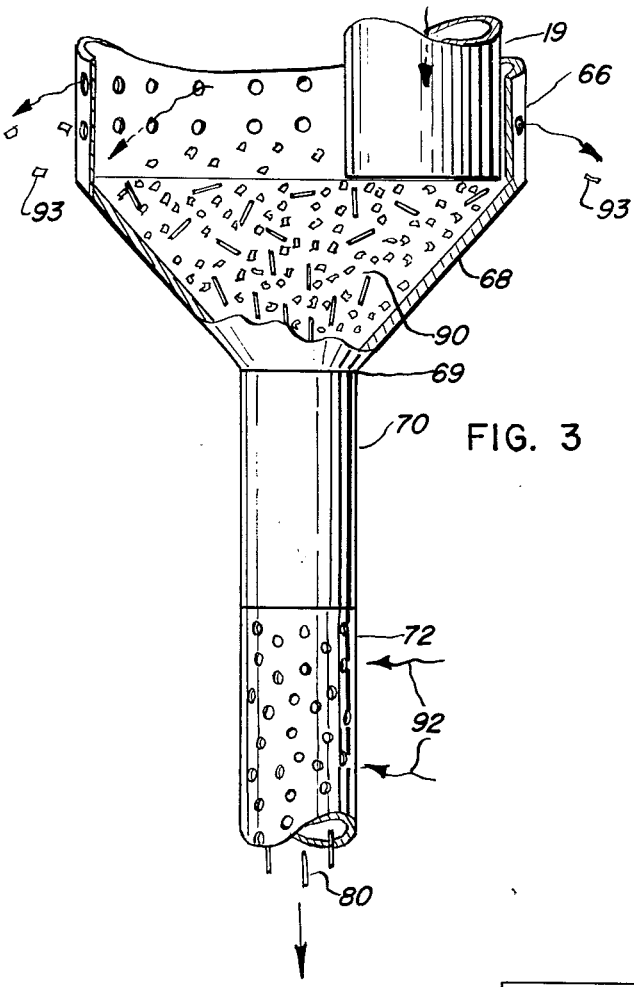
FIG. 3 is a partial sectional view of the separator assembly along the line 3—3 shown in FIG. 5 looking in the direction of the arrows.

To illustrate the operation of this invention, reference is made to FIGS. 2, 3 and 5. The hopper 18 is at least partially filled with a mixture of desired articles, such as the reed blades described above, and contaminant particles such as ten to twenty mesh crushed walnut shells, which may have been used previously to polish the reed blades. The mixture is conducted through the connecting transport tube 19 to the funnel 68 where it fills the funnel approximately to the top thereof forming the mass 90 therein. Air, or other suitable fluid, is forced into the chamber 44 through the tube 30 by the source 32. Since the chamber 44 is sealed, the only exhaust for the pressurized fluid is through the separator assembly 60. Consequently, the fluid enters the holes of the diffuser 72, as represented by the arrows 92, and flows upwardly through the tubular neck 70 to the base 69 of the funnel 68. There it interacts with the mass of contaminant particles and reed blades.

More specifically, the structure of the separator assembly 60, the sizes of the ports 14 and 28, and the pressure of the source 32 are predetermined to establish a fluid flow rate sufficiently high to create a "fluidized bed" in the mass 90, i.e., the flow is adequate to support the mass 90 and to simultaneously promote relative motion between the desired articles, contaminant particles and reed blades. It is not so high as to blow the mass 90 from the funnel, however. The reed blades, both lubricated and influenced by the fluid, tend to align themselves with the direction of fluid flow. Escaping fluid at the upper surface of the mass exits the relatively large holes of the separator cage 66 carrying with it individual contaminant particles 93. These particles collect in the area 94 adjacent the door 22 in the chamber 42.

At the base 69 of the funnel 68 the reed blades ultimately align themselves with the direction of fluid flow, i.e., vertically. Consequently, they present a substantially reduced cross section or area to the flow and can no longer be supported by that flow. As a result, they fall through the flow, under the influence of gravity, into the chamber 44 and collect in the area 96 adjacent the door 52.

As indicated, the flow rate is selected to achieve the above described results. In the illustrative embodiment wherein the base of the funnel 68 and the tube 70 are approximately 0.75 inch in diameter, the flow rate employed to separate reed blades approximately 0.885 inch long from 10 to 20 mesh walnut shells is approximately 1750 cubic feet per minute. The necessary flow rate is, however, related to the density of the fluid, the density of the articles and contaminants, and the average area of the contaminant particles. The pressure and flow rate must be such as to develop a total pressure, including dynamic pressure, at the base 69 of the funnel which will support the mass of contaminants and desired articles while the articles align themselves with the flow and yet permit aligned articles to fall therethrough.

It will be obvious that modifications of the specific embodiments shown may be made without departing from the spirit and scope of the invention.

It will be seen that improved separation apparatus and an improved method for operation thereof have been provided which meet the objects of the invention.

While a particular embodiment of this invention has been shown, it will be understood, of course, that the invention is not limited thereto since modifications may be made by those skilled in the art, particularly in light of the foregoing teachings. Therefore, it is contemplated by the appended claims to cover any such mofifications as incorporate those features which constitute the essential features of these improvements within the true spirit and scope of the invention.

What is claimed is:

1. Apparatus for separating articles, all having predetermined aerodynamic characteristics, from a mixture including randomly shaped particles, comprising:

a separator assembly including a funnel having first and second ports at opposing ends thereof, said first port being smaller than said second port, a tubular neck connected at one end to said first port, a diffuser of generally tubular shape, having a plurality of holes spaces about its perimeter, connected to the other end of said tubular neck;

hopper means for loading such a mixture into said second port of said funnel;

a housing having a diagonally bisecting plate to form a first chamber and a second chamber;

means for mounting said separator assembly in said housing with said funnel in said first chamber and said diffuser in said second chamber; and means for connecting said second chamber to a source of fluid pressure of a predetermined amplitude.

2. Apparatus as in claim 1 wherein said housing includes an access means for accessing the interior of said first chamber, said access means being positioned adjacent the base of said plate.

3. Apparatus for separating articles having a preferred aerodynamic axis from a mixture including randomly shaped particles, comprising:

first means for partially supporting a mass of such mixture in a gravity field, said first means having a port at the lowest point thereof in said gravity field, said first means comprises a funnel member of generally truncated conic shape having first and second apertures, said first aperture larger than said second aperture, said second aperture being said port;

second means for generating a flow of fluid, said second means comprises a housing having a plurality of chambers and having an inlet port in a first of said chambers, said inlet port being connected to a source of positive fluid pressure, said funnel member being mounted within said housing in a second of said chambers and communicating with said first chamber, said second means generating a predetermined flow rate sufficient for supporting such a mass substantially at said port while simultaneously lubricating the articles and the randomly shaped particles at the base of such a mass to promote relative motion therebetween;

third means connected to said port of said first means for directing said flow of fluid generated by said second means opposite the force of said gravity field against such a mass, said third means comprises a tube of generally cylindrical shape having a plurality of holes spaced about its perimeter at one end thereof, said tube being operatively coupled at its other end to said port of said first means and being mounted within said first chamber of said housing; and cage means connected to said second aperture of said funnel member having perforated sides and closed at its distal end for directing said fluid and such particles laterally from said funnel member.

4. Apparatus as in claim 3 further comprising:

hopper means for containing such a mixture; and means for operatively coupling said hopper means through said housing and said closed end of said cage means to said funnel member.

* * * * *